United States Patent [19]

Merchant

[11] Patent Number: 4,970,013

[45] Date of Patent: Nov. 13, 1990

[54] BINARY AZEOTROPIC COMPOSITION OF 2,3-DICHLORO-1,1,1,3-3-PENTAFLUORO-PROPANE AND METHANOL

[75] Inventor: Abid N. Merchant, Wilmington, Del.

[73] Assignee: E. I. duPont de Nemours and Company, Wilmington, Del.

[21] Appl. No.: 448,473

[22] Filed: Dec. 11, 1989

[51] Int. Cl.[5] ..... C11D 7/30; C11D 7/50

[52] U.S. Cl. ..... 252/69; 62/114; 134/12; 134/38; 134/39; 134/40; 252/67; 252/162; 252/170; 252/171; 252/172; 252/305; 252/364; 252/DIG. 9; 521/131

[58] Field of Search ..... 252/162, 170, 171, 172, 252/364, DIG. 9, 67, 69, 305; 62/114; 134/12, 38, 39, 40; 521/131; 203/67

[56] References Cited

U.S. PATENT DOCUMENTS 4,465,609 8/1984 Davis ..... 252/67

*Primary Examiner*—Paul Lieberman
*Assistant Examiner*—Kathleen Markowski

[57] ABSTRACT

Azeotropic mixtures of 2,3-dichloro-1,1,1,3,3-pentafluoropropane and methanol, the azeotropic mixtures being useful in solvent cleaning applications.

8 Claims, No Drawings

BINARY AZEOTROPIC COMPOSITION OF 2,3-DICHLORO-1,1,1,3-3-PENTAFLUOROPROPANE AND METHANOL

BACKGROUND OF THE INVENTION

As modern electronic circuit boards evolve toward increased circuit and component densities, thorough board cleaning after soldering becomes a more important criterion. Current industrial processes for soldering electronic components to circuit boards involve coating the entire circuit side of the board with flux and thereafter passing the flux-coated board over preheaters and through molten solder. The flux cleans the conductive metal parts and promotes solder fusion. Commonly used solder fluxes generally consist of rosin, either used alone or with activating additives, such as amine hydrochlorides or oxalic acid derivatives.

After soldering, which thermally degrades part of the rosin, the flux-residues are often removed from the circuit boards with an organic solvent. The requirements for such solvents are very stringent. Defluxing solvents should have the following characteristics: a low boiling point, be nonflammable, have low toxicity and have high solvency power, so that flux and flux-residues can be removed without damaging the substrate being cleaned.

While boiling point, flammability and solvent power characteristics can often be adjusted by preparing solvent mixtures, these mixtures are often unsatisfactory because they fractionate to an undesirable degree during use. Such solvent mixtures also fractionate during solvent distillation, which makes it virtually impossible to recover a solvent mixture with the original composition.

On the other hand, azeotropic mixtures, with their constant boiling points and constant compositions, have been found to be very useful for these applications. Azeotropic mixtures exhibit either a maximum or minimum boiling point and they do not fractionate on boiling. These characteristics are also important when using solvent compositions to remove solder fluxes and flux-residues from printed circuit boards. Preferential evaporation of the more volatile solvent mixture components would occur, if the mixtures were not azeotropic and would result in mixtures with changed compositions, and with attendant less-desirable solvency properties, such as lower rosin flux solvency and lower inertness toward the electrical components being cleaned. The azeotropic character is also desirable in vapor degreasing operations, where redistilled solvent is generally employed for final rinse cleaning.

In summary, vapor defluxing and degreasing systems act as a still. Unless the solvent composition exhibits a constant boiling point, i.e., is azeotropic, fractionation will occur and undesirable solvent distributions will result, which could detrimentally affect the safety and efficacy of the cleaning operation.

A number of chlorofluorocarbon based azeotropic compositions have been discovered and in some cases used as solvents for solder flux and flux-residue removal from printed circuit boards and also for miscellaneous degreasing application. For example: U.S. Pat. No. 3,903,009 discloses the ternary azeotrope of 1,1,2-trichloro-1,2,2-trifluoroethane with ethanol and nitromethane; U.S. Pat. No. 2,999,815 discloses the binary azeotrope of 1,1,2-trichloro-1,2,2-trifluoroethane and acetone; U.S. Pat. No. 2,999,817 discloses the binary azeotrope of 1,1,2-trichloro-1,2,2-trifluoroethane and methylene chloride.

Some of the chlorofluorocarbons which are currently used for cleaning and other applications have been theoretically linked to depletion of the earth's ozone layer. As early as the mid-1970's, it was known that introduction of hydrogen into the chemical structure of previously fully-halogenated chlorofluorocarbons reduced the chemical stability of these compounds. Hence, these now destabilized compounds would be expected to degrade in the lower atmosphere and not reach the stratospheric ozone layer in-tact. What is also needed, therefore, are substitute chlorofluorocarbons which have low theoretical ozone depletion potentials.

Unfortunately, as recognized in the art, it is not possible to predict the formation of azeotropes. This fact obviously complicates the search for new azeotropic compositions, which have application in the field. Nevertheless, there is a constant effort in the art to discover new azeotropes, which have desirable solvency characteristics and particularly greater versatilities in solvency power.

SUMMARY OF THE INVENTION

According to the present invention, an azeotrope has been discovered comprising admixtures of effective amounts of 2,3-dichloro-1,1,1,3,3-pentafluoropropane with methanol. More specifically, the azeotrope consists essentially of an admixture of about 92–98 weight percent 2,3-dichloro-1,1,1,3,3-pentafluoropropane and about 2–8 weight percent methanol.

The present invention provides nonflammable azeotropic compositions which are well suited for solvent cleaning, aerosal propellant, blowing agent and refrigerant applications.

DETAILED DESCRIPTION OF THE INVENTION

The compositions of the instant invention comprise admixtures of effective amounts of 2,3-dichloro-1,1,1,3,3-pentafluoropropane ($CF_3$—CHCl—$CClF_2$, boiling point=50.4° C.) and methanol (boiling point=64.6° C.) to form an azeotropic mixture. The aforementioned halocarbon is known as HCFC-225da, in nomenclature conventional to the halocarbon field.

By azeotropic composition is meant, a constant boiling liquid admixture of two or more substances, whose admixture behaves as a single substance, in that the vapor, produced by partial evaporation or distillation of the liquid has the same composition as the liquid, i.e., the admixture distills without substantial composition change. Constant boiling compositions, which are characterized as azeotropic, exhibit either a maximum or minimum boiling point, as compared with that of the nonazeotropic mixtures of the same substances.

For purposes of this invention, "consisting essentially of" is defined as the amount of each component of the instant invention admixture which, when combined, results in the formation of the azeotropes of instant invention. This definition includes the amounts of each component, which amounts may vary depending upon the pressure applied to the composition, which will cause a mixture to be formed which exhibits azeotropic characteristics, albeit over varying pressures and boiling points. Therefore, "consisting essentially of" includes the weight percentages of each component of the composition of the present invention, which form azeotropes at pressures other than atmosphere pressure. "Consisting essentially of" is not intended to exclude the presence of other materials which do not significantly affect the azeotropic nature of the azeotrope.

It is possible to characterize, in effect, a constant boiling admixture, which may appear under many guises, depending upon the conditions chosen, by any of several criteria:

The composition can be defined as an azeotrope of A and B, since the very term "azeotrope" is at once both definitive and limitative, and requires that effective amounts of A and B form this unique composition of matter, which is a constant boiling admixture.

It is well known by those skilled in the art that at different pressures, the composition of a given azeotrope will vary—at least to some degree—and changes in pressure will also change—at least to some degree—the boiling point temperature. Thus an azeotrope of A and B represents a unique type of relationship but with a variable composition which depends on temperature and/or pressure therefore compositional ranges, rather than fixed compositions, are often used to define azeotropes.

The composition can be defined as a particular weight percent relationship or mole percent relationship of A and B, while recognizing that such specific values point out only one particular such relationship and that in actuality, a series of such relationships, represented by A and B actually exist for a given azeotrope, varied by the influence of pressure.

Azeotrope A and B can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Binary mixtures of 92–98 weight percent 2,3-dichloro-1,1,1,3,3-pentafluoropropane and 2–8 weight percent methanol are characterized as azeotropes, in that mixtures within this range exhibit a substantially constant boiling point at constant pressure. Being substantially constant boiling, the mixtures do not tend to fractionate to any great extent upon evaporation After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true binary azeotrope. The binary composition consisting of about 95.5 weight percent 2,3-dichloro-1,1,1,3,3-pentafluoropropane and 4.5 weight percent methanol has been established, within the accuracy of the fractional distillation method, as a true binary azeotrope, boiling at about 45.2° C., at substantially atmospheric pressure.

The aforestated azeotrope has a low ozone-depletion potential and is expected to decompose almost completely, prior to reaching the stratosphere.

The azeotrope of the instant invention permits easy recovery and reuse of the solvent from vapor defluxing and degreasing operations because of its azeotropic nature. In addition, the azeotrope of the present invention is useful as an aerosol propellant, refrigerant and as a blowing agent for forming polymeric foams. As an example, the azeotropic mixture of this invention can be used in cleaning processes such as described in U.S. Pat. No. 3,881,949, which is incorporated herein by reference.

The azeotrope of the instant invention can be prepared by any convenient method including mixing or combining the desired component amounts. A preferred method is to weigh the desired component amounts and thereafter combine them in an appropriate container.

EXAMPLE 1

An ebullioscope was used to determine the composition versus boiling point temperature characteristics for the minimum boiling azeotrope, as follows: 2,3-dichloro-1,1,1,3,3-pentafluoropropane was placed in the distillation flask and brought to boiling at atmospheric pressure and the boiling points (vapor and liquid) were recorded. Small quantities of the individual binary component (methanol) were added to the distillation apparatus. The distillation was allowed to to reequilibrate for 30 minutes or less and the boiling points (vapor and liquid) were noted for that particular mixture composition.

When the mixture temperature reached its lowest boiling point for the given composition (temperature lower than the boiling points of either pure component), the temperature recorded was that of the azeotrope, at the azeotrope composition.

EXAMPLE 2

In order to verify the exact azeotropic composition and temperatures, two mixtures of 2,3-dichloro-1,1,1,3,3-pentafluoropropane and the individual binary component (methanol) were prepared with component contents slightly higher and slightly lower than the azeotropic composition. The mixtures were distilled in a twenty-five plate oldershaw column, at total reflux. Minimum boiling azeotropes were achieved with both mixture distillates. Head temperatures were corrected to 760 mm Hg pressure Azeotropic compositions were determined by gas chromatography.

A statistical analysis of the distillation data indicates that the true binary azeotrope of 2,3-dichloro-1,1,1,3,3-pentafluoropropane and methanol has the following characteristics at atmospheric pressure (99 percent confidence limits):

| | |
|---|---|
| 1,3-dichloro-1,1,1,3,3-pentafluoropropane | =95.5 ± 0.4 wt. % |
| Methanol | =4.5 ± 0.4 wt. % |
| Boiling point, °C. | =45.2 ± 2.8 |

EXAMPLE 3

Several single sided circuit boards were coated with activated rosin flux and soldering by passing the boards over a preheater, to obtain top side board temperatures of approximately 200° F. (93.3° C.), and then through 500° F. (260° C.) molten solder. The soldered boards were defluxed separately, with the azeotropic mixture cited in Example 1 above, by suspending a circuit board, first, for three minutes in the boiling sump, which contained the azeotropic mixture, then, for one minute in the rinse sump, which contained the same azeotropic mixture, and finally, for one minute in the solvent vapor above the boiling sump. The boards cleaned in the azeotropic mixture had no visible residue remaining thereon.

I claim:

1. An azeotropic composition consisting essentially of from about 92–98 weight percent 2,3-dichloro-1,1,1,3,3-pentafluoropropane and about 2–8 weight percent methanol wherein the composition has a boiling point of about 45.2° C., at substantially atmospheric pressure.

2. The azeotropic composition of claim 1, wherein the composition is about 95.5 weight percent 2,3-dichloro-1,1,1,3,3-pentafluoropropane and about 4.5 weight percent methanol.

3. A process for cleaning a solid surface which comprises treating said surface with the azeotropic composition of claim 1.

4. The process of claim 3, wherein the solid surface is a printed circuit board contaminated with flux and flux-residues.

5. The process of claim 3, wherein the solid surface is a metal.

6. A process for heating or cooling comprising the use of the azeotropic composition of claim 2.

7. A process for preparing a polymeric foam utilizing an effective amount of the azeotropic composition of claim 1.

8. A process of preparing aerosol formulation wherein the active ingredients are combined in an aerosol container with the azeotropic composition of claim 1, said azeotropic composition functioning as a propellant.

* * * * *